US008002611B2

(12) United States Patent
He et al.

(10) Patent No.: US 8,002,611 B2
(45) Date of Patent: Aug. 23, 2011

(54) CHEMICAL MECHANICAL POLISHING PAD HAVING IMPROVED GROOVE PATTERN

(75) Inventors: Yanghua He, Richardson, TX (US); Jingqiu Chen, Dallas, TX (US); Yaojian Leng, Grapevine, TX (US)

(73) Assignee: Texas Instruments Incorporated, Dallas, TX (US)

( * ) Notice: Subject to any disclaimer, the term of this patent is extended or adjusted under 35 U.S.C. 154(b) by 634 days.

(21) Appl. No.: 11/964,141

(22) Filed: Dec. 26, 2007

(65) Prior Publication Data

US 2008/0160890 A1 Jul. 3, 2008

Related U.S. Application Data

(60) Provisional application No. 60/877,301, filed on Dec. 27, 2006.

(51) Int. Cl.
*B24D 11/00* (2006.01)

(52) U.S. Cl. ..... 451/527; 451/550

(58) Field of Classification Search ..... 451/36, 451/59, 60, 446, 527, 528, 529, 550
See application file for complete search history.

(56) References Cited

U.S. PATENT DOCUMENTS 5,597,443 A 1/1997 Hempel
5,702,290 A 12/1997 Leach
5,823,854 A 10/1998 Chen
5,868,896 A 2/1999 Robinson et al.
5,876,271 A * 3/1999 Oliver ..... 451/60
5,882,251 A * 3/1999 Berman et al. ..... 451/527
5,888,121 A * 3/1999 Kirchner et al. ..... 451/41
5,895,270 A 4/1999 Hempel, Jr.
5,996,594 A 12/1999 Roy et al.
6,169,034 B1 1/2001 Avanzino et al.
6,241,596 B1 * 6/2001 Osterheld et al. ..... 451/527
6,254,456 B1 * 7/2001 Kirchner et al. ..... 451/41
6,390,891 B1 * 5/2002 Guha et al. ..... 451/41
6,458,015 B1 10/2002 Robinson et al.
6,648,743 B1 * 11/2003 Burke ..... 451/526
6,692,338 B1 * 2/2004 Kirchner ..... 451/41
6,736,926 B2 5/2004 Chopra et al.
6,947,862 B2 * 9/2005 Eaton et al. ..... 702/100
7,140,955 B2 * 11/2006 Nabeya ..... 451/287
7,314,402 B2 * 1/2008 Laursen et al. ..... 451/41
2002/0146908 A1 * 10/2002 Chadda et al. ..... 438/691
2003/0034131 A1 * 2/2003 Park et al. ..... 156/345.12
2006/0270325 A1 * 11/2006 Choi ..... 451/285

* cited by examiner

*Primary Examiner* — Timothy V Eley
(74) *Attorney, Agent, or Firm* — Warren L. Franz; Wade J. Brady, III; Frederick J. Telecky, Jr.

(57) ABSTRACT

A chemical mechanical polishing pad and method for chemical-mechanical polishing is provided, wherein the polishing pad has a plurality of first mesas and one or more second mesas defined on a surface thereof. The plurality of first mesas are generally distributed about the surface of the polishing pad, wherein each of the plurality of first mesas has a first surface area associated therewith. The one or more second mesas are associated with a center region of the polishing pad, wherein each of the one or more second mesas has a second surface area associated therewith. The second surface area is at least twice the first surface area.

14 Claims, 12 Drawing Sheets

CHEMICAL MECHANICAL POLISHING PAD HAVING IMPROVED GROOVE PATTERN

RELATED APPLICATION

This application claims priority to Ser. No. 60/877,301 filed Dec. 27, 2006, which is entitled "Chemical Mechanical Polishing Pad Having Improved Groove Pattern".

FIELD OF THE INVENTION

The present invention relates generally to semiconductor processing, and more particularly to a chemical-mechanical polishing ("CMP") apparatus for polishing a workpiece. Specifically, the present invention relates to an improved groove pattern for a CMP pad.

BACKGROUND OF THE INVENTION

Chemical-mechanical processing of a semiconductor wafer or substrate may include forming a dielectric layer over the semiconductor substrate, etching a plurality of trenches into the dielectric layer, and forming a metal layer, such as a tungsten layer, over the dielectric layer and the trenches, wherein the trenches are generally filled by the metal layer. A portion of the metal layer may be further removed via an abrasive polishing pad of a chemical-mechanical polishing (CMP) apparatus, wherein the polishing pad orbits with respect to the wafer. The wafer may further rotate with respect to the orbiting polishing pad, wherein a slurry composition is typically disposed on the side of the polishing pad in contact with the various layers on the wafer, and wherein the slurry composition assists in polishing and/or oxidizing the layers.

One problem conventionally seen in CMP processing involves metals remaining on product wafers after the CMP process is performed. A conventional CMP apparatus typically comprises circular polishing pads having grooves defined therein for slurry distribution to between the polishing pad and the wafer. In an orbiting CMP apparatus, excess metal can remain on a center of the wafer after the CMP process is complete due to a slow removal rate associated with a center of the conventional polishing pad.

SUMMARY OF THE INVENTION

Therefore, a need has arisen for a CMP polishing pad that overcomes these and other shortcomings of the related art. The following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

The present invention is generally directed toward a chemical-mechanical polishing apparatus, and more specifically, to a polishing pad for a CMP apparatus. Thus, a CMP polishing pad is provided, wherein the polishing pad has a plurality of first mesas and one or more second mesas defined on a surface thereof. The plurality of first mesas are generally distributed about the surface of the polishing pad, wherein each of the plurality of first mesas has a first surface area associated therewith. The plurality of first mesas, for example, are generally defined by a plurality of first horizontal grooves and a plurality of first vertical grooves defined in the surface. The plurality of first horizontal grooves are spaced a first distance from each other, and the plurality of first vertical grooves are further spaced the first distance from each other, wherein the plurality of first vertical grooves are generally perpendicular to the plurality of first horizontal grooves. Thus, the plurality of first vertical grooves and plurality of first horizontal grooves generally define a plurality of first mesas.

In accordance with one exemplary aspect of the invention, at least two second horizontal grooves and at least two second vertical grooves are further defined in the surface, wherein the at least two second vertical grooves are generally perpendicular to the at least two second horizontal grooves. The plurality of second vertical grooves and plurality of second horizontal grooves further generally define one or more second mesas having a second surface associated therewith, wherein the second surface area is greater than the first surface area.

The one or more second mesas, for example, are associated with a center region of the polishing pad, wherein the second surface area is at least twice the first surface area. Thus, the one or more second mesas associated with the center region of the polishing pad provide a greater mechanical and chemical polishing to a wafer than polishing pads of the prior art, since the greater surface area provides a greater amount of friction between the polishing pad and the wafer, as well as decreasing corners that may be worn during conditioning of the polishing pad.

In described example embodiments, a chemical-mechanical polishing pad is provided such as for use in an orbital chemical-mechanical polishing (CMP) polisher. The described pad takes the form of a circular disk having a polishing surface with an X-Y (horizontal-vertical) groove pattern. X-direction (horizontal) grooves are formed at chord positions equally spaced in the Y direction (vertically) across substantially the entire polishing surface, with no X-direction grooves in an X-direction (horizontal) band portion covering at least a central region. The X-direction (horizontal) band portion has a width that extends on either side of an X-direction (horizontal) diameter for a Y-direction (vertical) distance greater than the X-direction (horizontal) groove equal spacing. Y-direction (vertical) grooves are formed at chord positions equally spaced in the X direction (horizontally) across substantially the entire polishing surface, with no Y-direction grooves in a Y-direction (vertical) band portion covering at least the central region. The Y-direction (vertical) band portion has a width that extends on either side of a Y-direction (vertical) diameter for an X-direction (horizontal) distance greater than the Y-direction (vertical) groove equal spacing. The width of the X-direction band on either side of the X-direction diameter is at least two times the X-direction groove equal spacing. The width of the Y-direction (vertical) band on either side of the Y-direction (vertical) diameter is at least two times the Y-direction (vertical) groove equal spacing. In some embodiments, the X-direction (horizontal) grooves extend through the Y-direction (vertical) band and the Y-direction (vertical) grooves extend through the X-direction (horizontal) band. In some embodiments, the X-direction (horizontal) band extends in the X-direction (horizontally) on either side of the central region and the Y-direction (vertical) band extends in the Y-direction (vertically) on either side of the central region, with the two bands intersecting in a cross shape at the central region. The grooves interconnect with holes in non-central region portions of the disk for introduction of slurry during polishing. The groove equal spacing in the Y (vertical) direction may be the same as the groove equal spacing in the X (horizontal) direction.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
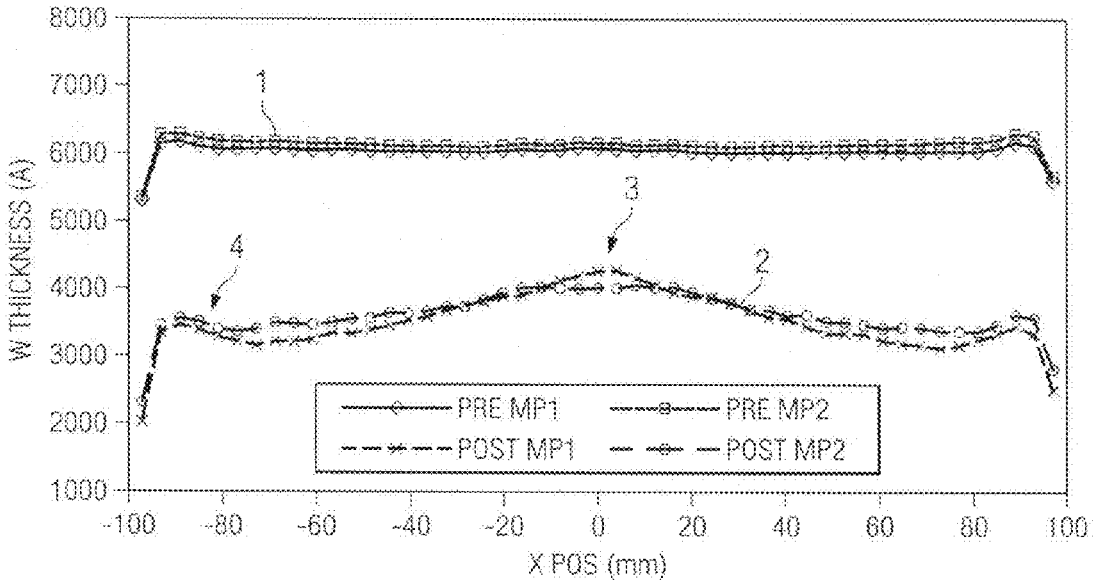
FIG. 1 is a graph illustrating a diameter scan of a wafer before and after CMP processing.

The present invention is directed towards chemical-mechanical polishing (CMP) of a workpiece, wherein defects are generally mitigated. Accordingly, the present invention will now be described with reference to the drawings, wherein like reference numerals are used to refer to like elements throughout. It should be understood that the description of these aspects are merely illustrative and that they should not be taken in a limiting sense. In the following description, for purposes of explanation, numerous specific details are set forth in order to provide a thorough understanding of the present invention. It will be evident to one skilled in the art, however, that the present invention may be practiced without these specific details.

In a tungsten CMP process, for example, a tungsten layer is formed over a wafer, wherein the tungsten generally "overfills" grooves or plugs that have been etched on a surface of a dielectric layer of the wafer, thus defining an overburden of tungsten material, as is commonly known. A CMP process is utilized to polish, or remove, the overburden of tungsten material down to the grooves in the dielectric layer, at which point, the CMP process is stopped. From time to time, the tungsten is not removed properly in a center portion of the wafer, thus leaving electrical "shorts", where conductive material remains in the center portion of the wafer. Typically, the cause of the shorts is due to a slow material removal rate associated with the center of the polishing pad.

A profile across a diameter of an exemplary wafer is shown in FIG. 1. Curve 1 illustrates a diameter scan across a blank wafer prior to CMP processing, wherein the tungsten layer has been generally evenly formed over the wafer. The diameter scan is achieved by measuring a thickness of the wafer across a diametric line. Typically, curve 1 is a generally straight line prior to a CMP polish. Curve 2 illustrates another diameter scan across the wafer after CMP polishing, wherein a non-linear profile is generated. While a linear profile similar to curve 1 is desirable, in practice, non-linear profiles such as curve 2 are frequently achieved, wherein a center region 3 has a greater thickness than peripheral regions 4, meaning there is less material removed in the center of the wafer than in the peripheral regions.

Typically, the greater amount of material remaining in the center of the wafer needs to be removed, wherein the wafer is generally re-worked in the CMP process, wherein the polish is again performed (e.g., an "over-polish") for a certain amount of time. Typically, the over-polish will reduce the thickness in the center, however, the over-polish typically not only decreases the center thickness, but also decreases the thickness of the remaining portions of the wafer, since the whole wafer is generally subjected to the polish. One additional re-work of the wafer is typically acceptable, however, subsequent re-polishing or re-working of the wafer can cause potential problems with electrical interconnections in otherwise good devices on the wafer, as well as various other problems. Thus, re-working wafers is not an optimal solution, since remaining good dies or devices can be negatively affected. Further, re-working wafer is time-consuming, thus adversely affecting productivity.

Another problem seen in conventional CMP processes involves relatively short pad lives for the polishing pads. A typical polishing pad used in polishing a 200 mm wafer is approximately 10 inches (254 mm) in diameter, and the pad is moderately flexible. Conventionally, the polishing pads tend to wear more in the center of the pad than the periphery. It is believed by the inventors that this is due to re-conditioning of the pads, wherein after one or more wafers are polished, the pad surface is refreshed or conditioned in an attempt to rejuvenate the pad surface, and wherein residual metals are typically removed from the pad surface by a diamond scraper.

FIG. 2A illustrates a conventional polishing pad 10, wherein the pad comprises a polishing surface 15. Conventionally, the polishing surface 15 is generally abrasive, wherein a plurality of generally equally-spaced grooves 20 are cut into the surface. The polishing surface 15 thus generally provides mechanical polishing of the wafer (not shown), while the grooves 20 generally provide a route for a slurry (not shown) to be introduced between the wafer and the polishing pad 10. Thus, the grooves 20 form a generally perpendicular X-Y pattern of bands 25 in the polishing surface 15 for mechanically polishing the wafer. The plurality of grooves further generally interconnect a plurality of holes 30 defined in the polishing pad 10, wherein the slurry is generally introduced to the polishing pad through the plurality of holes, and wherein the grooves 20 generally distribute the slurry about the surface 15 of the polishing pad.

During reconditioning of the polishing pad 10, the polishing pad is typically mounted on a thin metal sheet (not shown), and a downward force is typically applied to the polishing pad by a pad conditioning apparatus. It is desirable that the polishing pad remain substantially planar during conditioning, however, in practice, the polishing pad will typically deform and become generally convex due to the flexible nature of the polishing pad and the force applied thereto. Pressure is further applied to the polishing surface 15 of the polishing pad 10 by a diamond scraper (not shown) that is scraped along the polishing surface of the polishing pad. Thus, if the polishing pad 10 is generally convex during conditioning, the diamond scraper will condition the polishing pad generally non-uniformly, wherein the convex shape will tend to cause more wear to the polishing surface near a center 35 of the pad (e.g., near the apex of the convex polishing pad). Since more wear tends to occur near the center 35 of the polishing pad 10 during conditioning, this wear on the polishing pad also contributes to the center of the wafer (not shown) not being polished adequately. As such, conventionally, polishing pads need to be replaced frequently when wear on the center of the pad exceeds a certain amount. Further, since there are a plurality of grooves in the center 35, corners of the grooves 20 tend to wear even more in the center of the polishing pad upon repeated conditioning.

During process qualification (a procedure where the process is examined for reliability, etc.), a pilot wafer (e.g., a test wafer) is used to check for polish uniformity, particles, etc. Typically, process qualification is performed each day before product wafers are polished, in order to maintain quality processing throughout the production process. Wear in the center 35 of the polishing pad 10, however, can cause polish uniformities measured during process qualification to be out of a specification range, and valuable time is typically spent troubleshooting, replacing polishing pads, etc., thus increasing production downtime. Relatively short polishing pad life also increases the cost of ownership of the CMP apparatus and process.

Figure 3B:
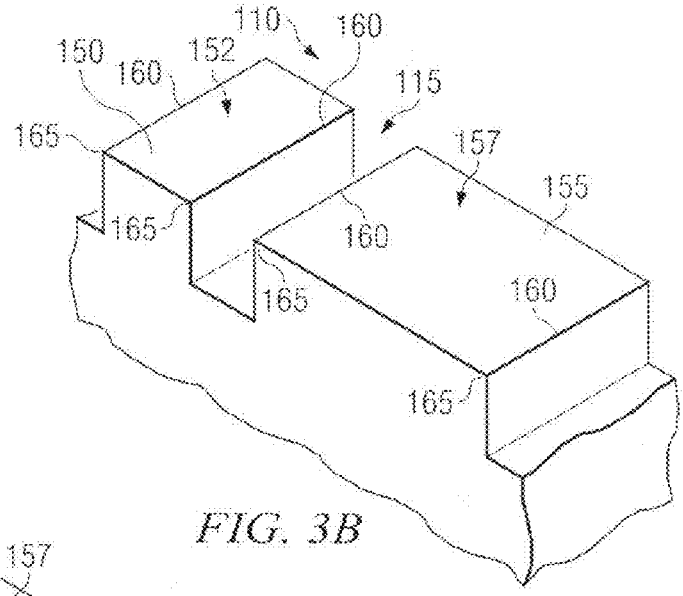
FIG. 3B is a partial perspective view of a plurality of first and second mesas having sharp corners and edges, in accordance with another exemplary aspect of the present invention.
Figure 3C:
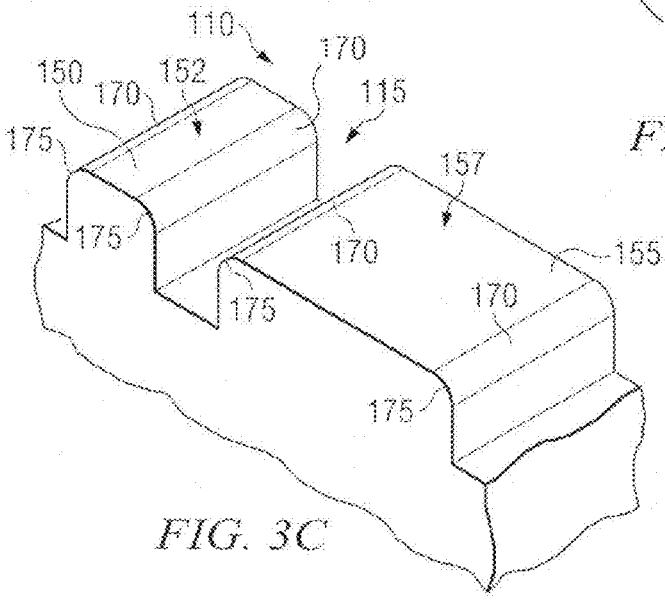
FIG. 3C is a partial perspective view of the plurality of first and second mesas of FIG. 3B having rounded corners and edges after conditioning, in accordance with yet another exemplary aspect of the present invention.
Figure 2:
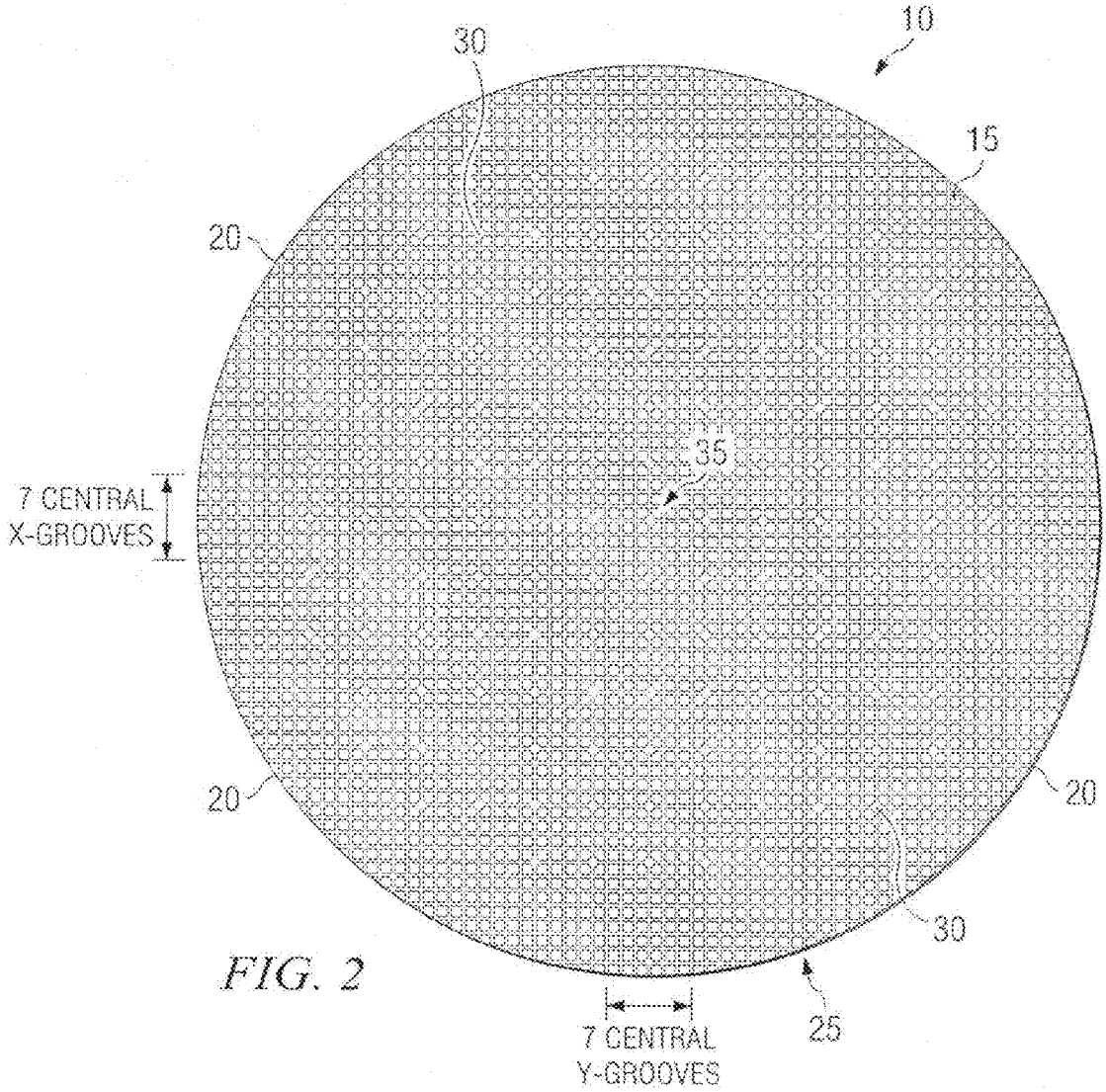
FIG. 2 is a plan view of an exemplary CMP pad having a generally perpendicular groove pattern.
Figure 3A:
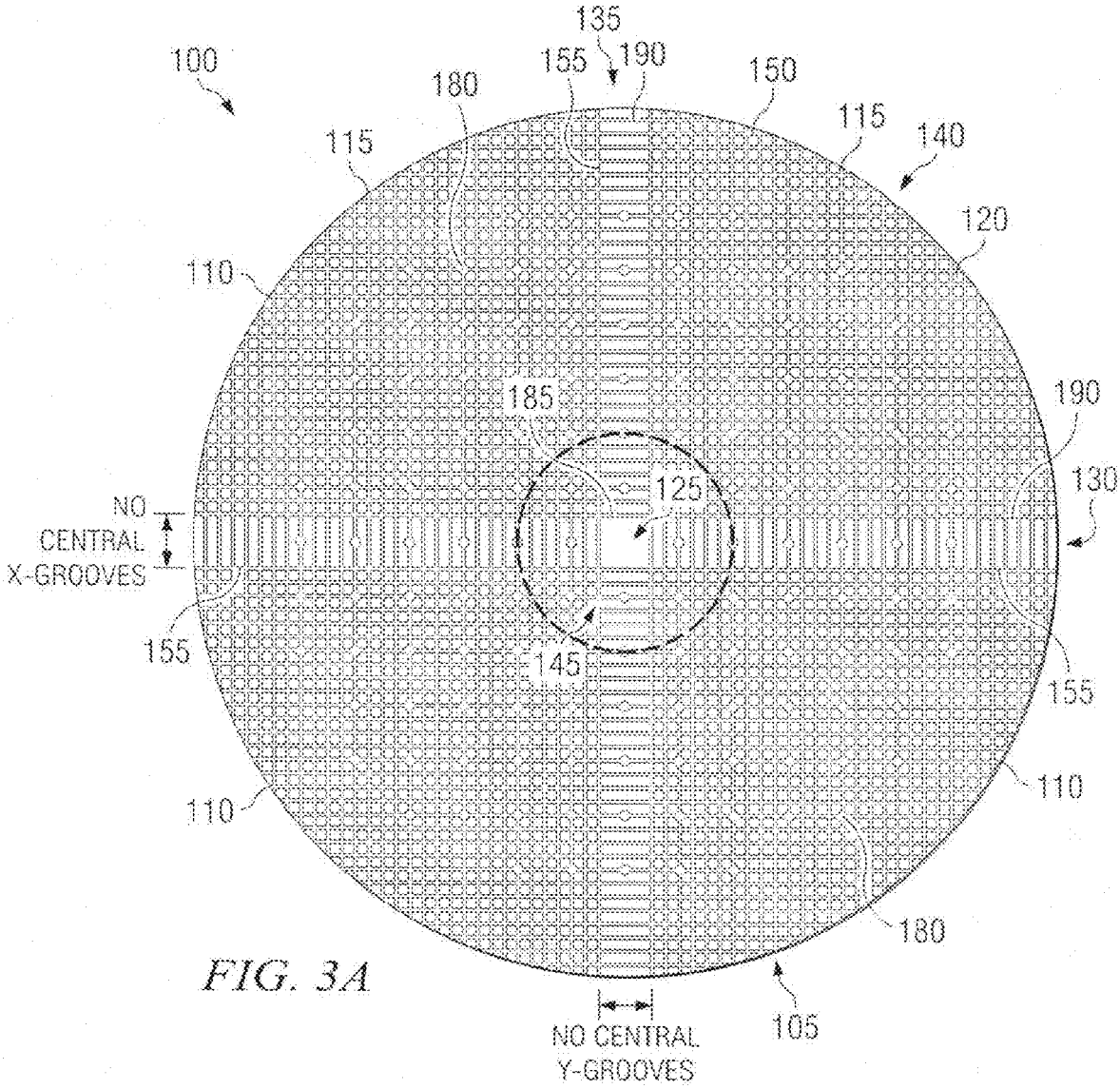
FIG. 3A is a plan view of an exemplary CMP pad having a plurality of first mesas and at least one second mesa, in accordance with one exemplary aspect of the present invention.
Figure 4:
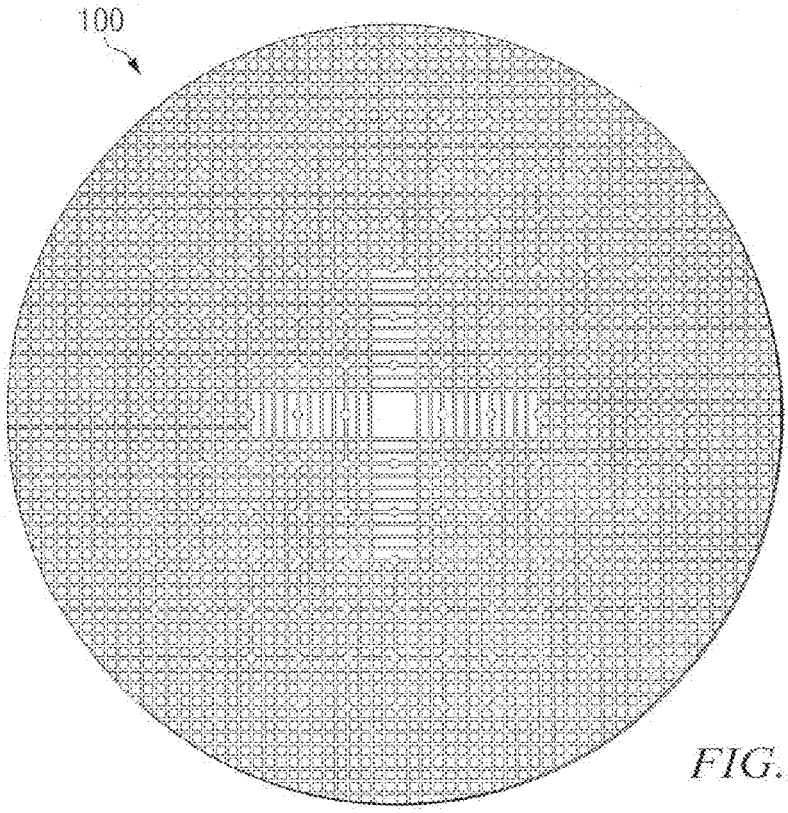
FIGS. 4-20 illustrate respective plan views of various CMP pads in accordance with various other exemplary aspects of the present invention.
Figure 5:
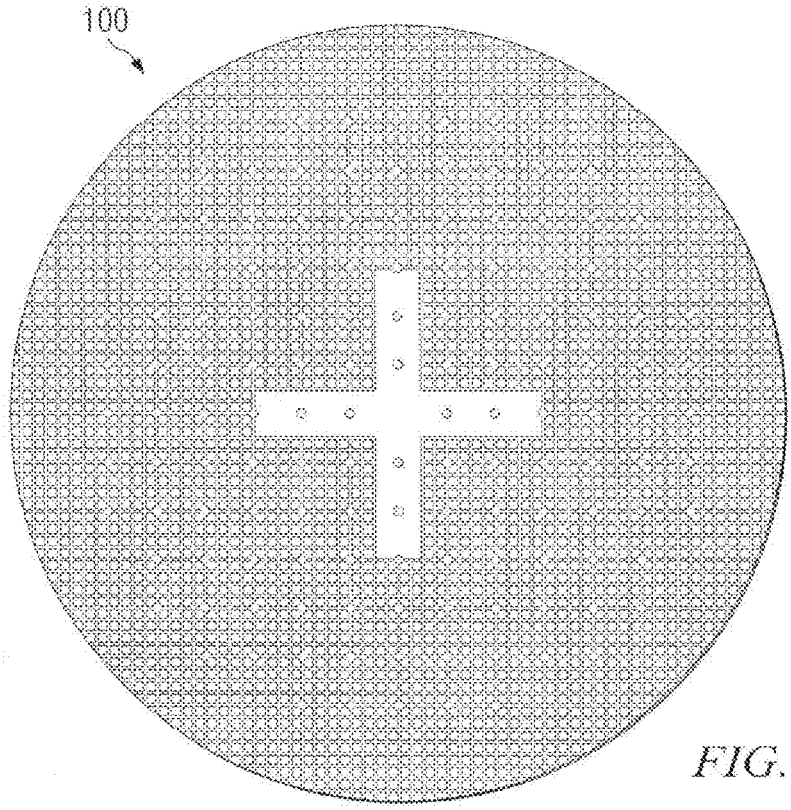
Figure 6:
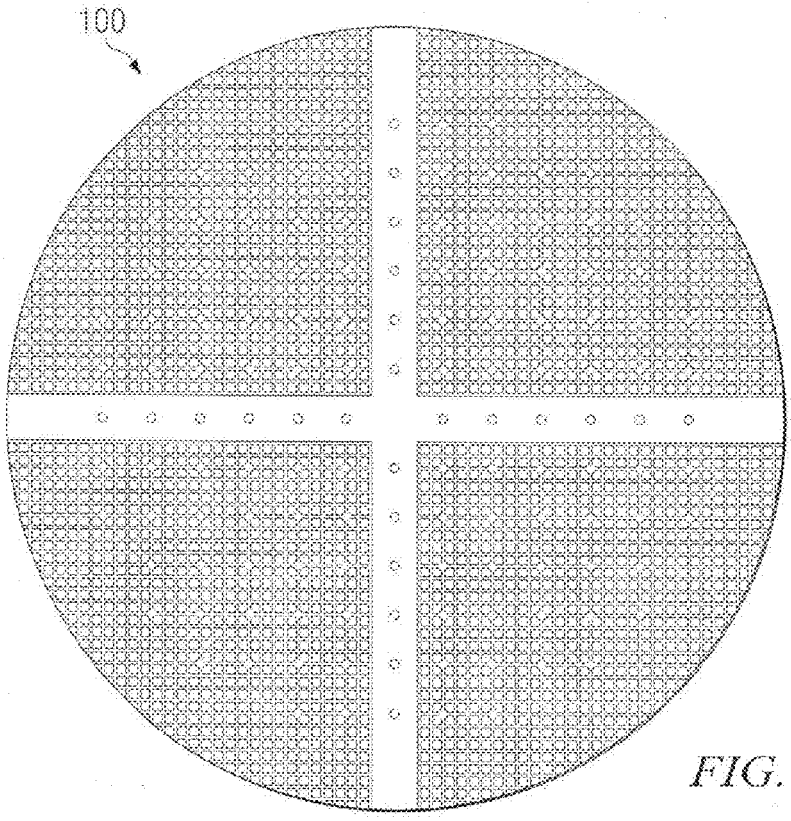
Figure 7:
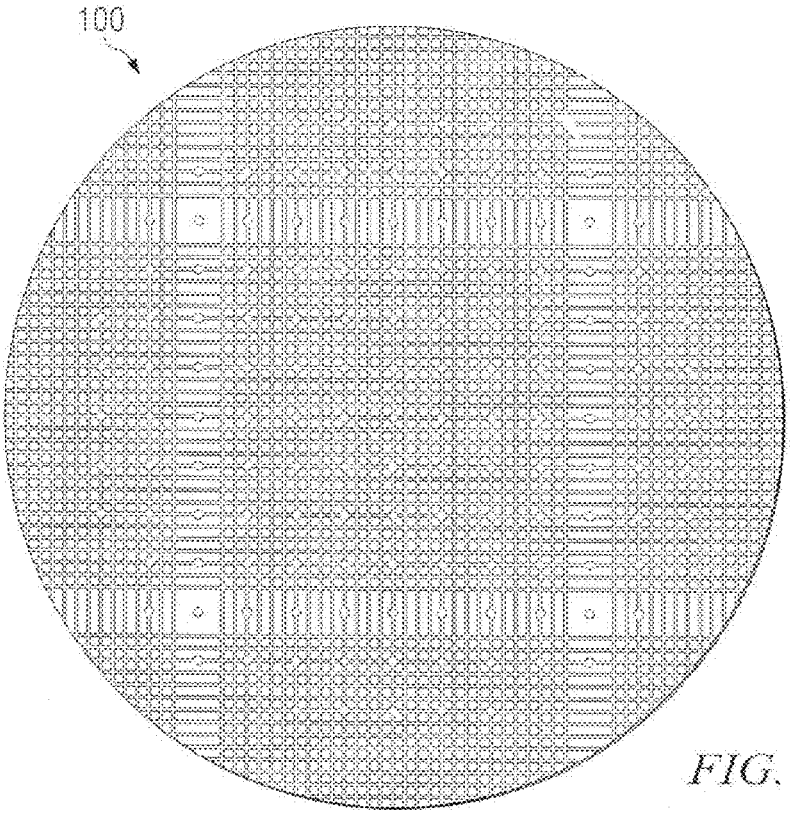
Figure 8:
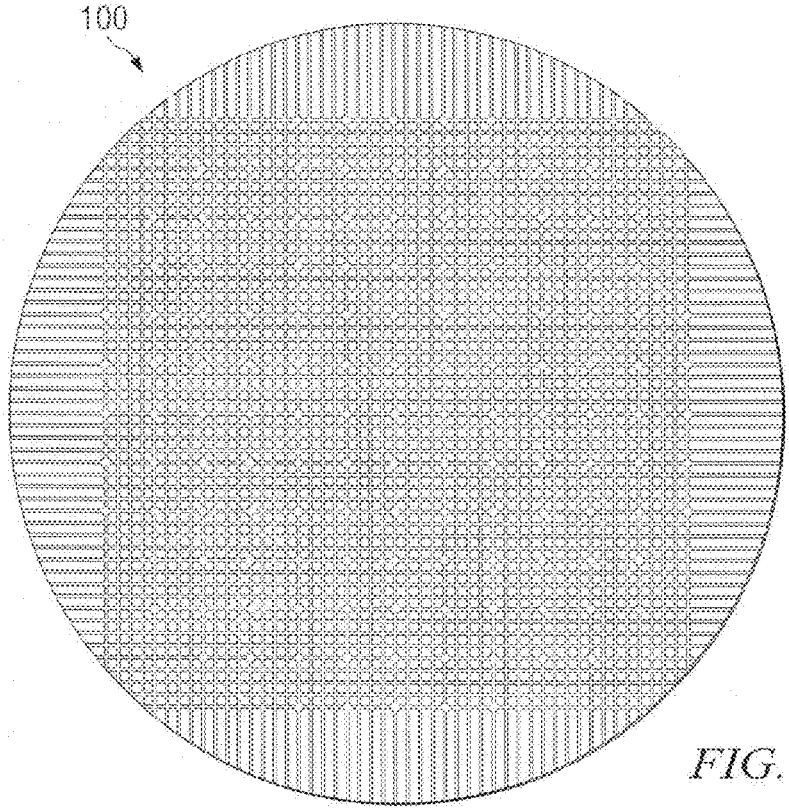
Figure 9:
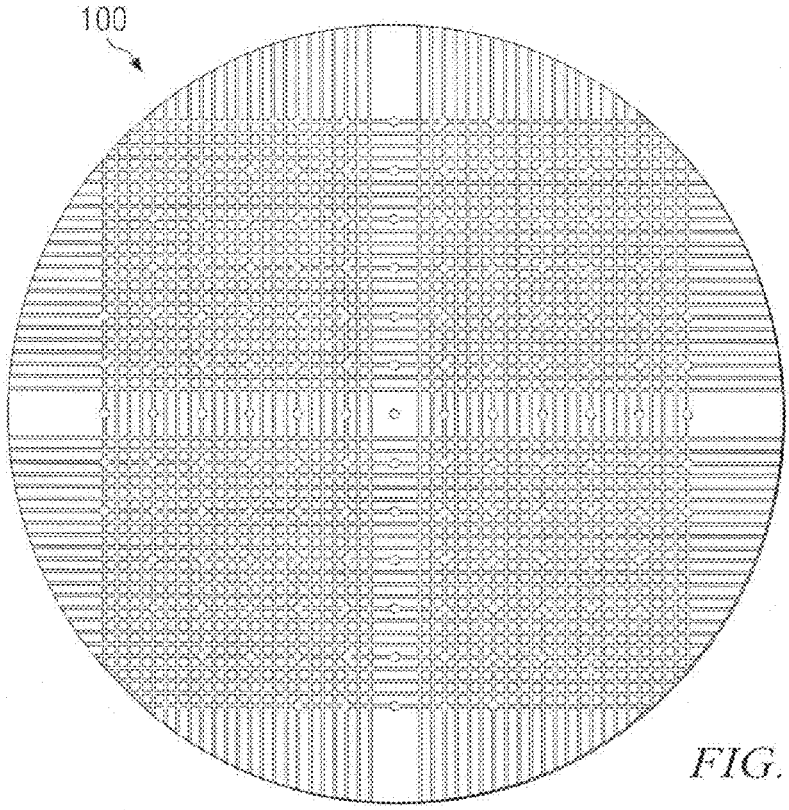
Figure 10:
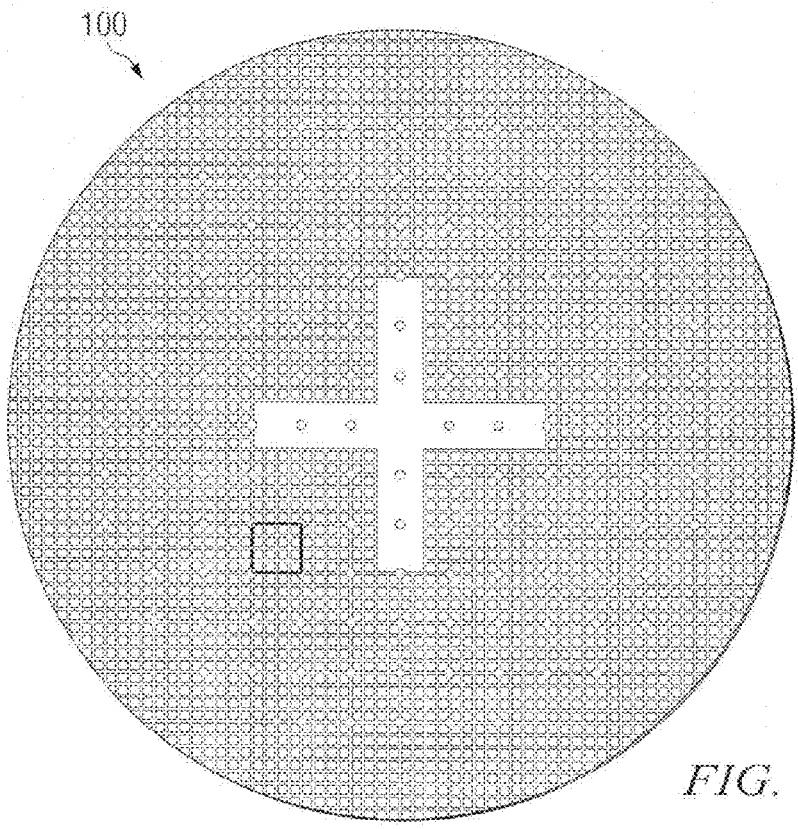
Figure 11:
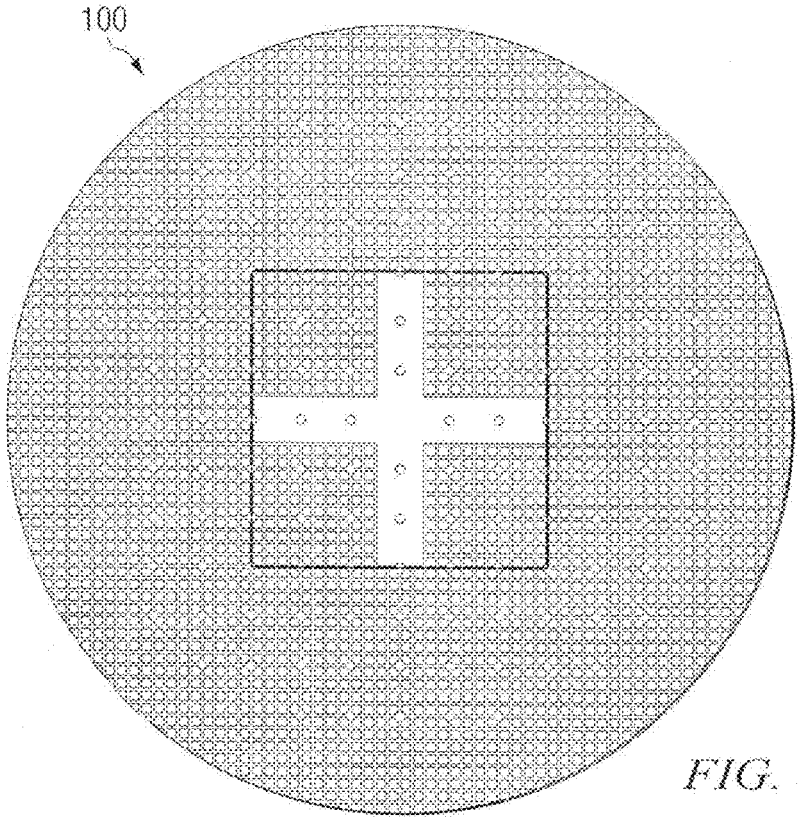
Figure 12:
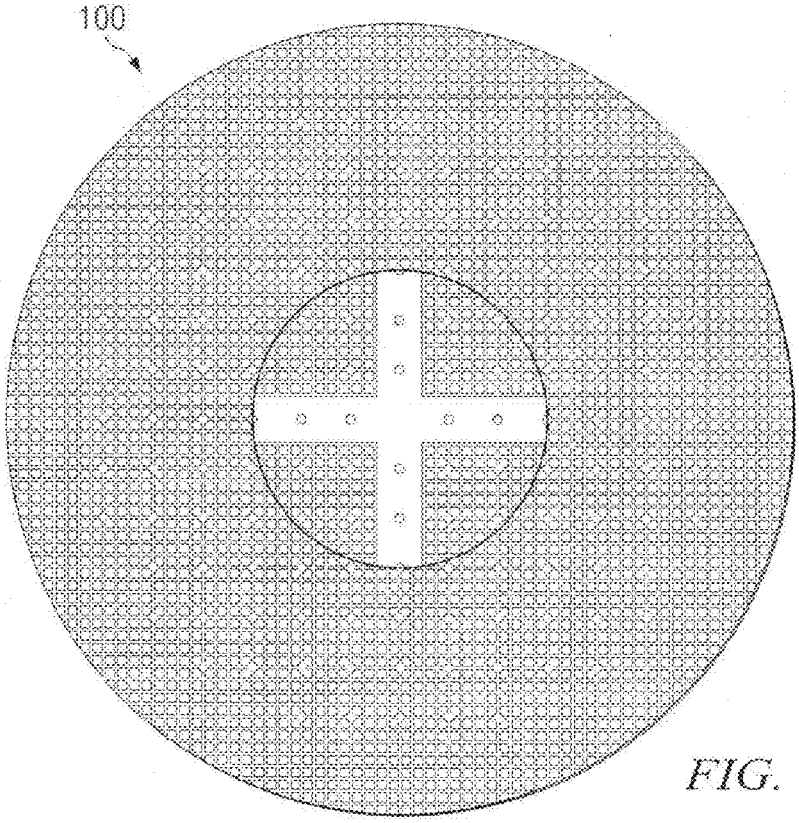
Figure 13:
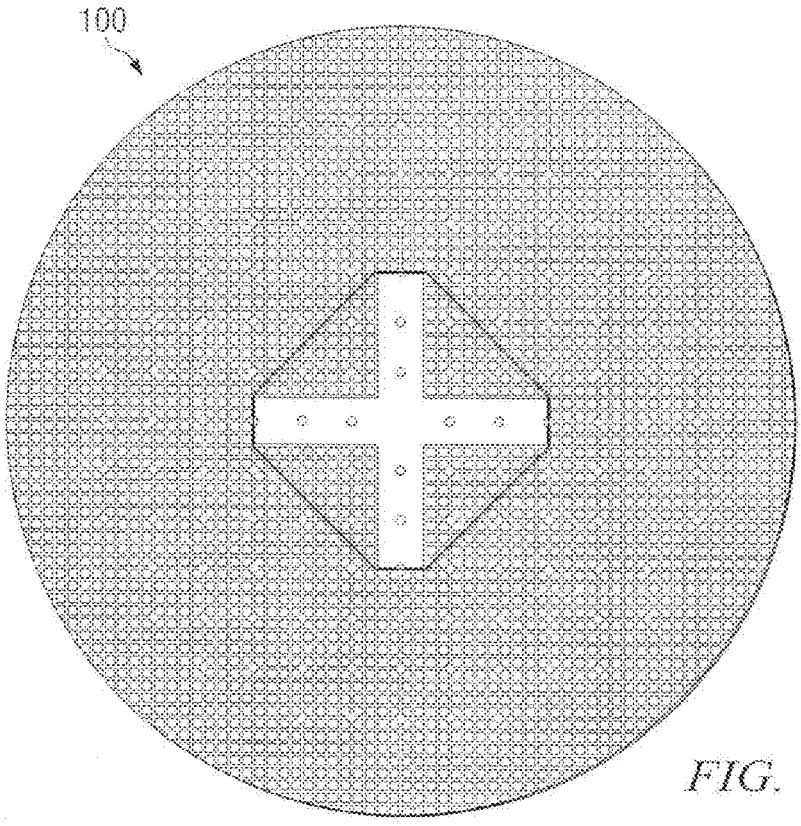
Figure 14:
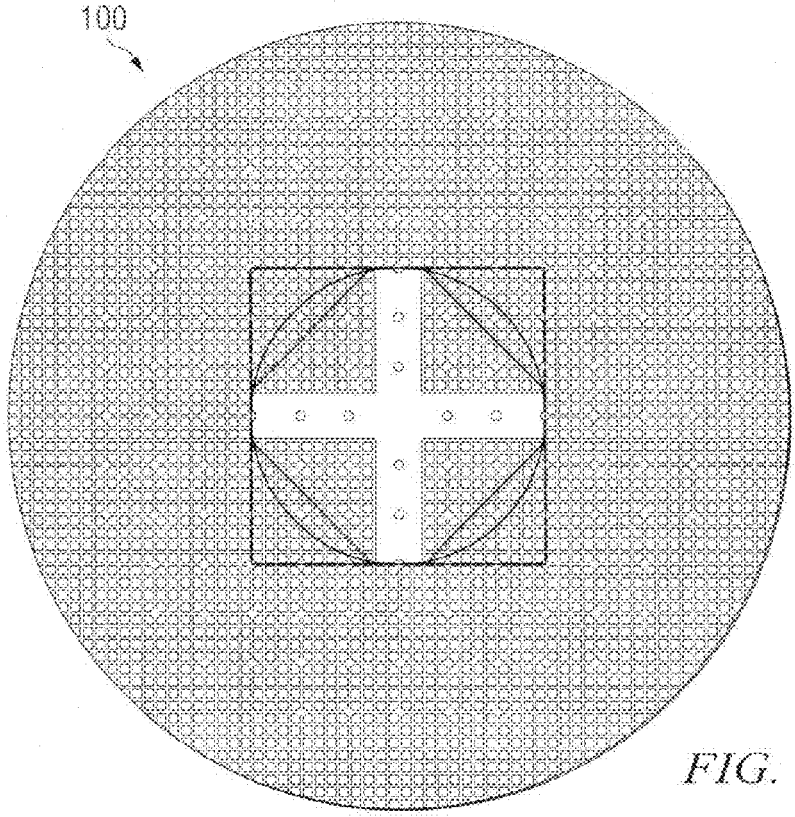
Figure 15:
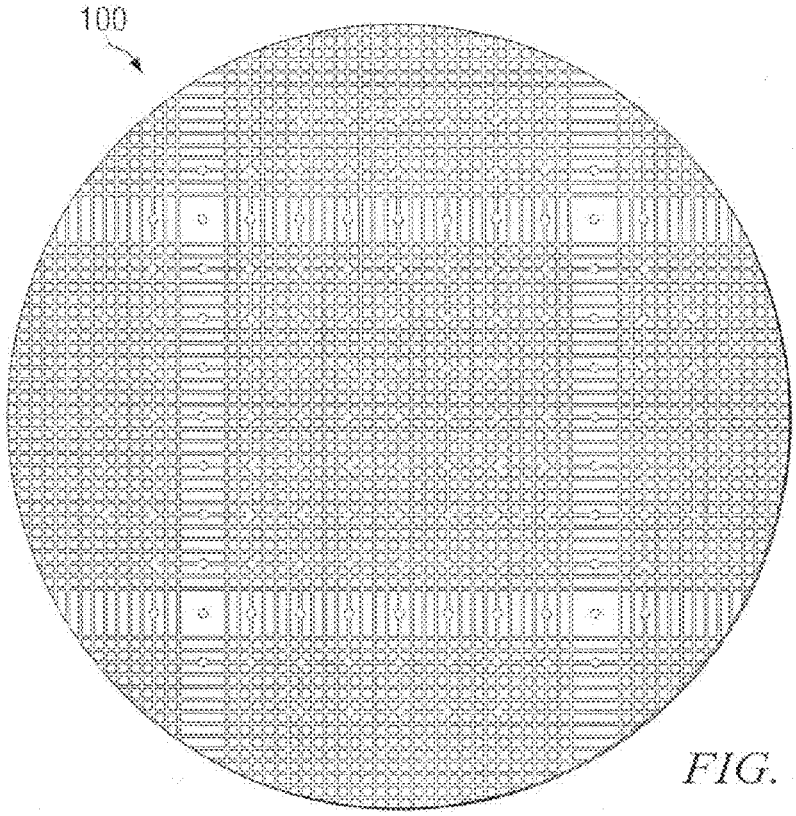
Figure 16:
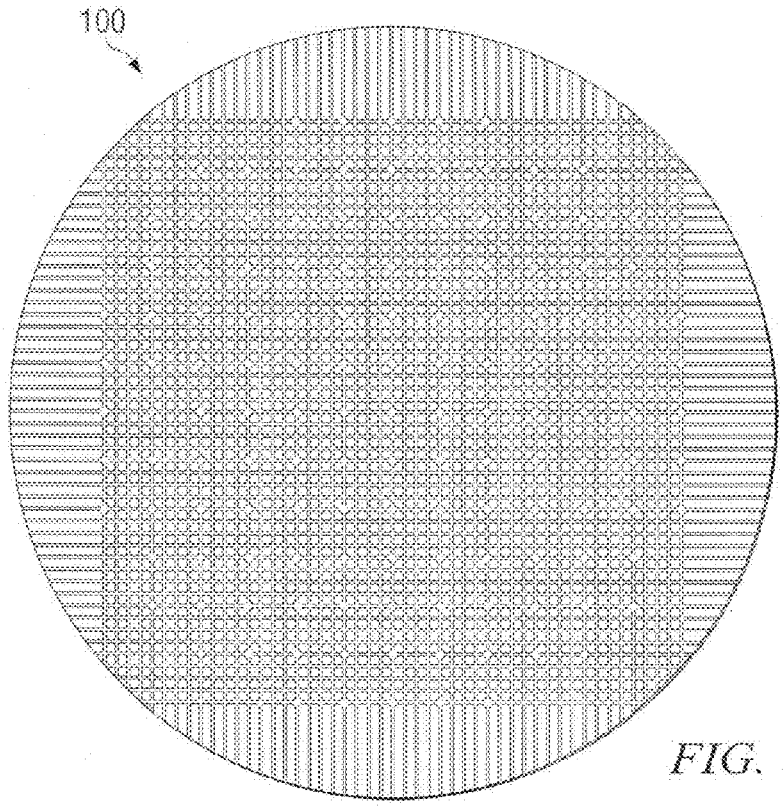
Figure 17:
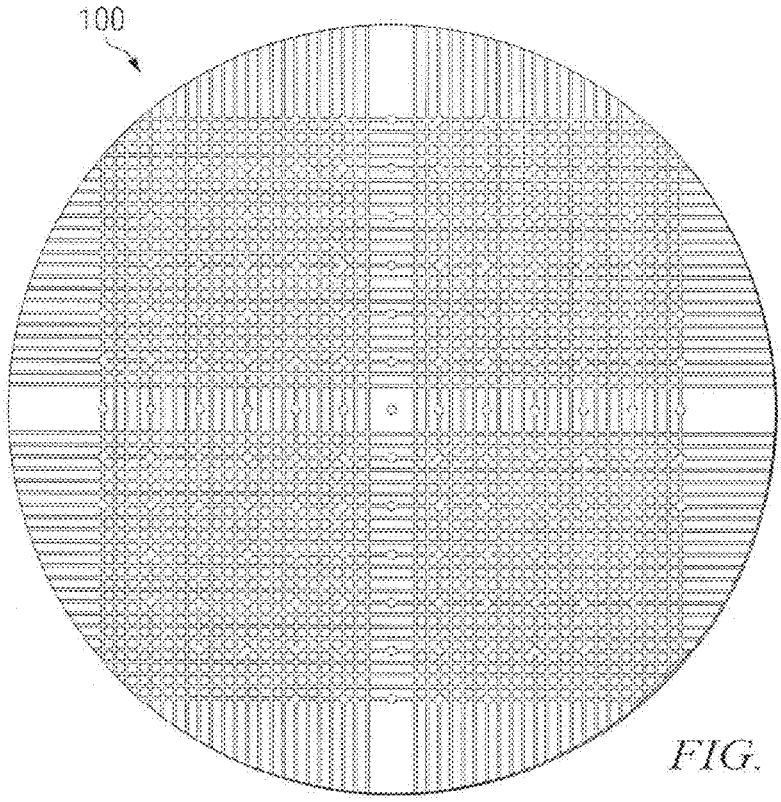
Figure 18:
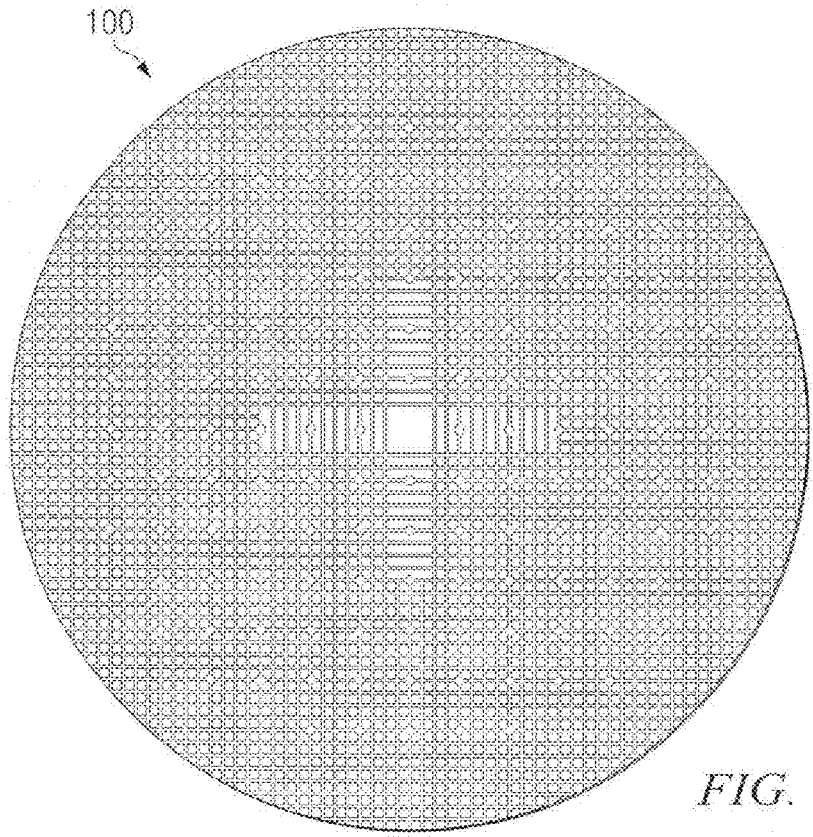
Figure 19:
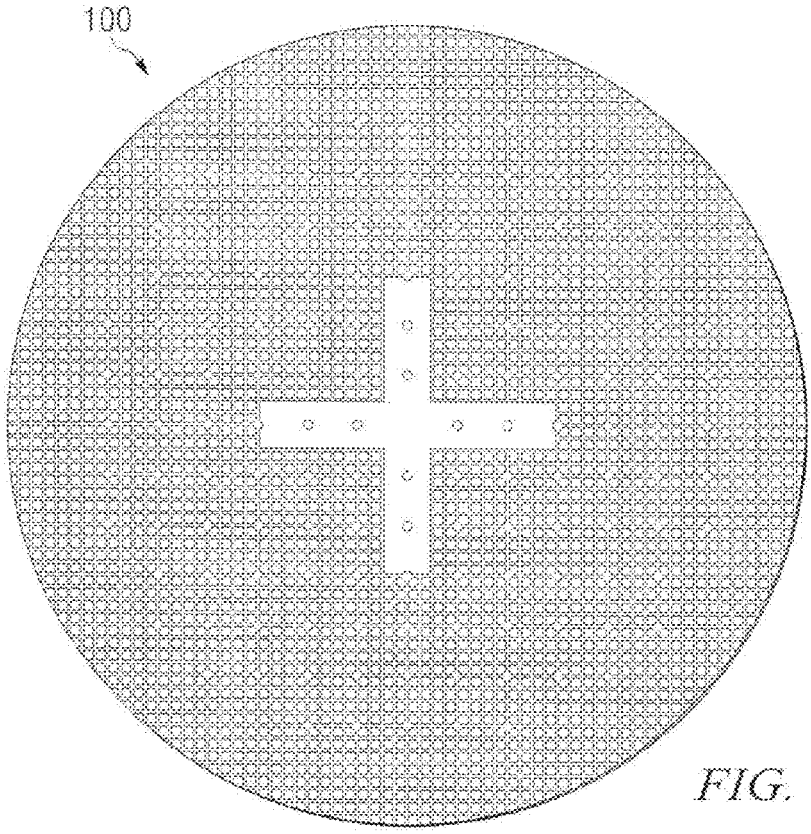
Figure 20:
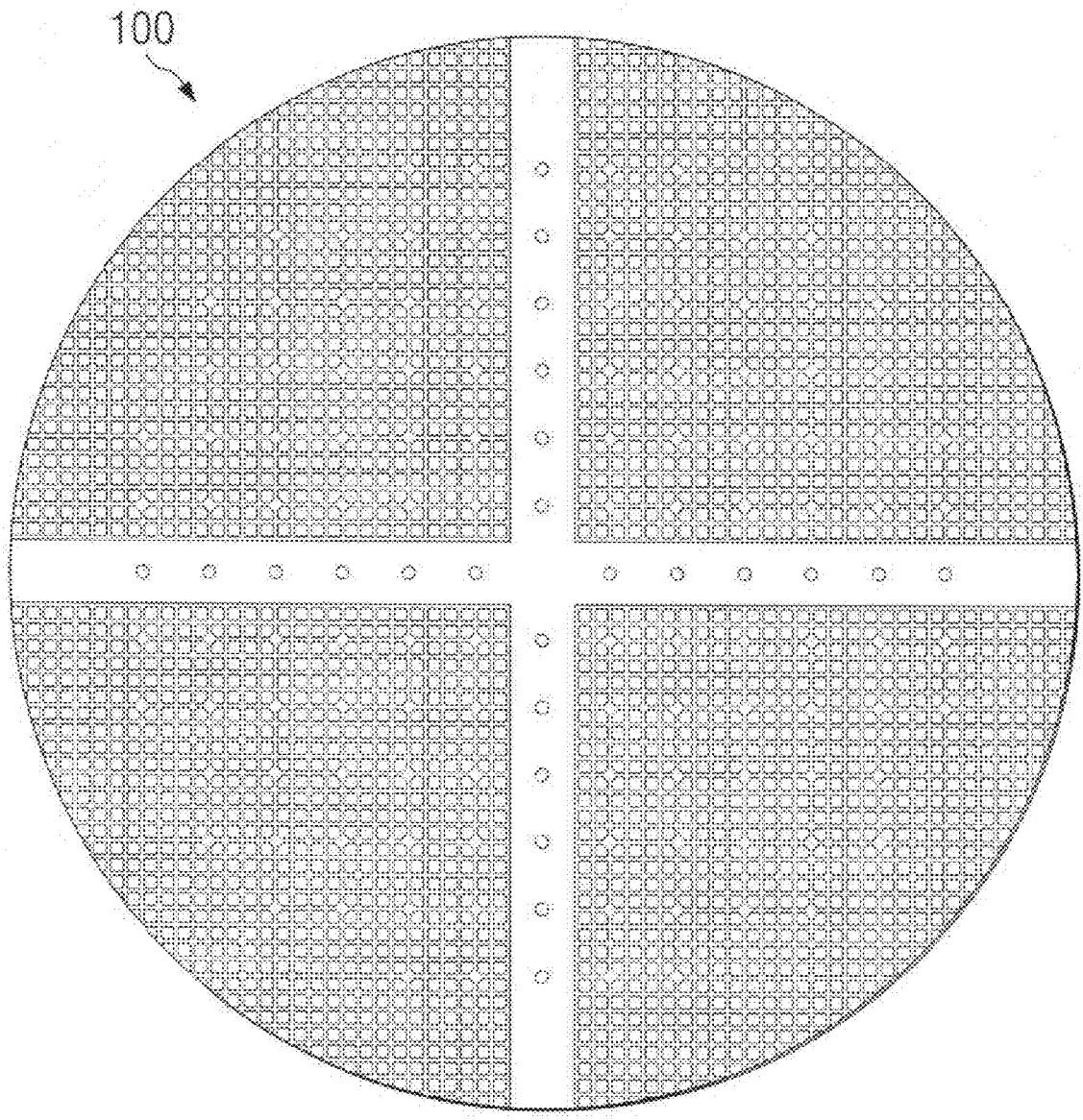

Accordingly, FIG. 3A illustrates one exemplary aspect of the present invention, wherein a polishing pad 100 for an orbital CMP polisher (single orbiting pad) is provided having a modified X-Y groove pattern 105 having a plurality horizontal grooves 110 and vertical grooves 115 defined in a surface 120 thereof. The polishing pad 100 differs from the polishing pad 10 of FIG. 2 by some of the horizontal grooves 110 and vertical grooves 115 associated with a center region 125 of the polishing pad 100 of FIG. 3A being removed. In the conventional polishing pad 10 of FIG. 2, for example, the arrangement of the plurality of grooves 20 is generally symmetric about the surface 15 of the pad 10, wherein the plurality of grooves are further generally equally spaced from one another. According to the present invention, a generally solid horizontal cross-band 130 and a generally solid vertical cross-band 135 are provided across the surface 120 of the polishing pad 100 of FIG. 3A, wherein the horizontal and vertical cross-bands are generally wider than the bands 25 of FIG. 2. Thus, one or more of the plurality of grooves 20 of FIG. 2 are generally not present in the present invention, thus providing the horizontal cross-band 130 and vertical cross-band 135 of FIG. 3A. Multiple grooves 20 of FIG. 2 may be further removed, (3, 5, etc.), thus providing wider horizontal and vertical cross-bands 130 and 135, respectively.

According to the present invention, the absence of the horizontal and vertical cross-bands 130 and 135 (as compared to the conventional pad 10 of FIG. 2) generally increases the polishing pad surface 120 associated with the center region 125 of the polishing pad 100 of FIG. 3A, thus increasing an amount of polishing material associated with the pad center region 125. Further, providing the horizontal and vertical cross-bands 130 and 135 by removing the X-Y grooves 20 of FIG. 2 near the center region 125 of the polishing pad 100 also generally provides fewer edges of the respective cross-bands, as will be further discussed hereafter. Thus, near the center 125 region of the polishing pad 100, a generally greater degree of solid surface 120 is provided by the cross bands 130 and 135, as compared to a peripheral region 140 of the polishing pad. The peripheral region 140, for example, comprises a greater number of horizontal and vertical grooves 110 and 115 than the center region 125.

The polishing pad 100 of the present invention thus provides a larger central cross band 145 associated with the center region 125 of the polishing pad, thus providing greater contact area between the center region of the polishing pad and the wafer than that in the peripheral region 140. Accordingly, the center region 125 has proportionately more pad material in contract with the wafer than the peripheral region 140. As such, mechanical polishing of the wafer can be greater in the center region 125 than in the peripheral region 140. The CMP process, for example, is part mechanical and part chemical, wherein the mechanical aspect of CMP abrades the wafer surface via the polishing pad 100. The horizontal grooves 110 and vertical grooves 115, however, further provide for slurry delivery to the surface 120 of the polishing pad 100. Thus, when fewer horizontal grooves 110 and vertical grooves 115 are present, there is less slurry provided to the center region 125 and thus more pad material for the mechanical abrading of the wafer. Further, the inventors appreciate that with less slurry in the center region 125, the temperature is increased due, at least in part, to frictional forces, and the increase in temperature further aids in increasing the abrasion or removal rate due, at least in part, to elevating the temperature for the chemical reaction.

While not detailed in the Figures, the polishing pad comprises 2 subsets of groove patterns. One subset comprises the horizontal and vertical grooves 110 and 115 discussed above, and the other is called "k-grooves" (not shown), wherein the k-grooves generally spiral about the surface 120 of the pad 100 for further slurry distribution. The present invention is directed to the removal of one or more of horizontal and vertical grooves 110 and 115. In the present example, the k-grooves remain intact, and are substantially finer grooves. As such, the k-grooves are still operable to provide slurry throughout the polishing pad 100, but not to the degree as the horizontal and vertical grooves 110 and 115.

Thus, the present invention provides both increased mechanical polishing as well as increased chemical polishing. The horizontal and vertical grooves 110 and 115, for example, can be likened to a highway or high-flow conduit for the slurry to contact the wafer surface. By removing one or more horizontal and vertical grooves 110 and 115, as compared to conventional pads, thus defining the horizontal and vertical cross-bands 130 and 135, the slurry is limited by the cross-bands to going through the k-grooves, thus providing less slurry to the areas of the cross bands. Less slurry thus provides less liquid, and thus, more friction. Accordingly, the temperature is increased, and increased temperature will tend to make the chemical reaction (e.g., oxidization etc.) occur faster.

The horizontal and vertical grooves 110 and 115, for example, generally define a plurality of first mesas 150 that are distributed about the surface 120 of the polishing pad 100, wherein each of the first mesas have a first surface area 152 associated therewith, as illustrated in FIG. 3B. The horizontal and vertical cross-bands 130 and 135 of FIG. 3A, for example, further define one or more second mesas 155, wherein each of the one or more second mesas have a second surface area 157 illustrated, for example, in FIG. 3B, that is substantially greater than the first surface area 152 of each of the plurality of first mesas 150. Further, as illustrated in FIG. 3B, the horizontal and vertical grooves 110 and 115 generally define sharp edges 160 and sharp corners 165 associated with the first and second mesas 150 and 155. The sharp edges 160 and sharp corners 165, for example, can be worn during conditioning of the polishing pad 100, therein producing rounded edges 170 and rounded corners 175 as a result, as illustrated in FIG. 3C. In the center 125 of the polishing pad 100 of FIG. 3A, for example, this wear can contribute to decreased polishing associated with the center of the pad, and thus, the wafer.

While the horizontal and vertical grooves 110 and 115 are generally designed for the transport of slurry, the sharp edges 160 and sharp corners 165 of FIG. 3B can also assist in polishing the wafer like a blade. While the major mechanical polishing effect is from the surface 120 of the pad 100, the edges 160 and corners 165 of FIG. 3B can also have an effect on polishing, and thus, wear on the edges can also decrease the effectiveness of the pad. Thus, another advantageous aspect of the invention is that the polishing pad of the present invention provides fewer edges 160 and corners 165 by providing the plurality of second mesas 155 having the second surface area 157 that is greater than the first surface area 152, thus providing greater mechanical polishing efficiency.

The polishing pad 100 of the present invention illustrated in FIG. 3A, for example, further comprises a plurality of slurry delivery holes 180 generally disposed at intersections of the horizontal and vertical grooves 110 and 115 (e.g., a slurry delivery hole position at approximately every four grooves). The present invention further provides no slurry delivery hole 180 in the center 125, thus eliminating the large amount of slurry that emanates from central holes of the prior art.

In accordance with another exemplary aspect of the invention, FIGS. 4-20 illustrate several variations of the horizontal and vertical grooves 110 and 115 and horizontal and vertical cross-bands 130 and 135, wherein the cross bands need not extend across the polishing pad surface (e.g., the entire diameter), nor do the cross bands need extend all the way to the center 125. For example, some horizontal and vertical grooves 110 and 115 can be left to reveal horizontal and vertical cross-bands 130 and 135 in various configurations. In one example, horizontal and vertical cross-bands 130 and 135 generally define a contiguous square 185 (e.g., one of the second mesas 155) in the center 125, as illustrated in FIG. 3A, while a remainder of the cross bands are generally rectangular mesas 190. Accordingly, all such cross bands, mesas, and deviations thereof, such as curved or round mesas, or other geometrically-shaped mesas are contemplated as falling within the scope of the present invention.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated example embodiments of the invention. In addition, while a particular feature of the invention may have been disclosed with respect to only one of several aspects of the invention, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed is:

1. A chemical-mechanical polishing pad comprising a circular disk having a polishing surface with an X-Y groove pattern; the polishing surface formed with X-direction grooves at chord positions equally spaced in the Y direction across substantially the entire polishing surface, with no X-direction grooves in an X-direction band portion covering at least a central region of the polishing surface and having a width that extends on either side of an X-direction diameter for a Y-direction distance greater than the X-direction groove equal spacing; and the polishing surface further being formed with Y-direction grooves at chord positions equally spaced in the X direction across substantially the entire polishing surface, with no Y-direction grooves in a Y-direction band portion covering at least the central region of the polishing surface and having a width that extends on either side of a Y-direction diameter for an X-direction distance greater than the Y-direction groove equal spacing.

2. The pad of claim 1, wherein the width of the X-direction band on either side of the X-direction diameter is at least two times the X-direction groove equal spacing.

3. The pad of claim 2, wherein the width of the Y-direction band on either side of the Y-direction diameter is at least two times the Y-direction groove equal spacing.

4. The pad of claim 3, wherein the X-direction grooves extend through the Y-direction band; and the Y-direction grooves extend through the X-direction band.

5. The pad of claim 4, wherein the X-direction band extends in the X-direction on either side of the central region; the Y-direction band extends in the Y-direction on either side of the central region; and the X-direction and Y-direction bands intersect in a cross shape at the central region.

6. The pad of claim 5, wherein the X-direction grooves and Y-direction grooves interconnect with holes defined in the pad for introduction of slurry during polishing.

7. The pad of claim 6, wherein the pad is configured for use in an orbital CMP polisher.

8. The pad of claim 3, wherein the X-direction band extends in the X-direction on either side of the central region; the Y-direction band extends in the Y-direction on either side of the central region; and the X-direction and Y-direction bands intersect in a cross shape at the central region.

9. The pad of claim 1, wherein the X-direction grooves extend through the Y-direction band; and the Y-direction grooves extend through the X-direction band.

10. The pad of claim 1, wherein the X-direction band extends in the X-direction on either side of the central region; the Y-direction band extends in the Y-direction on either side of the central region; and the X-direction and Y-direction bands intersect in a cross shape at the central region.

11. The pad of claim 1, wherein the X-direction grooves and Y-direction grooves interconnect with holes defined in the pad for introduction of slurry during polishing.

12. The pad of claim 11, wherein there are no holes in the central region.

13. The pad of claim 1, wherein the Y-direction groove equal spacing is the same as the X-direction groove equal spacing.

14. The pad of claim 1, wherein the pad is configured for use in an orbital CMP polisher.

* * * * *